US005746069A

United States Patent [19]

Kim

[11] Patent Number: 5,746,069

[45] Date of Patent: May 5, 1998

[54] CLOTHES WASHING MACHINE HAVING UPPER AND LOWER DYNAMIC BALANCERS

[75] Inventor: Do Weon Kim, Seoul, Rep. of Korea

[73] Assignee: Samsung Electronics Co., Ltd., Suwon, Rep. of Korea

[21] Appl. No.: 697,567

[22] Filed: Aug. 28, 1996

[30] Foreign Application Priority Data

Aug. 28, 1995 [KR] Rep. of Korea ..... 95-26953

[51] Int. Cl.[6] ..... D06F 37/24

[52] U.S. Cl. ..... 68/23.2; 74/573 F

[58] Field of Search ..... 68/23.2; 210/144, 210/363, 364; 74/573 F, 573 R

[56] References Cited

U.S. PATENT DOCUMENTS 5,460,017 10/1995 Taylor ..... 68/23.2

*Primary Examiner*—Philip R. Coe

*Attorney, Agent, or Firm*—Burns, Doane, Swecker & Mathis, L.L.P.

[57] ABSTRACT

A clothes washing machine includes a spin basket on which dynamic balancers are arranged. Upper and lower balancers are mounted on the top and bottom of the spin basket, respectively. Each of the upper and lower balancers includes a plurality of separate coaxial chambers. Viscous oil and movable balls are disposed in each chamber. The chambers of the upper balancer are arranged one above the other and the cross sections of those chambers (as well as of the balls) become larger in an upward direction. The chambers of the lower balancer are arranged horizontally next to one another and the cross sections of those chambers (as well as of the balls) become larger in a radially outer direction.

1 Claim, 6 Drawing Sheets

CLOTHES WASHING MACHINE HAVING UPPER AND LOWER DYNAMIC BALANCERS

FIELD OF THE INVENTION

This invention relates to a washing machine, more particularly, to a washing machine in which balancers for keeping the dynamic balance of a spin basket are mounted on the spin basket.

BACKGROUND OF THE INVENTION

FIG. 5 illustrates a cross-sectional view of a washing machine equipped with a conventional balancing device.

The washing machine includes a spin basket 2 and a fixed basket 3 disposed inside of a main body 1. The spin basket 2 has a number of drain holes on its surface and serves as a hydro-extracting or spin drying basket. The fixed basket 3 is mounted outside of the spin basket 2 and serves as a container for containing water. The fixed basket 3 is supported by suspension arms 4 fixed to the top of the main body 1. The washing machine also includes a pulsator 5 which is located on the inner bottom of the spin basket 2, and a driving unit 6 that is installed under the spin basket 2 so as to rotate the spin basket 2 and the pulsator 5.

In such a washing machine, laundering is performed by the action of detergent and water put into the washing machine and water current generated by the rotation of the pulsator 5, and dehydrating is performed by centrifugal force acting on the so as to leave the wash with just enough moisture for ironing. Full automatic washing machines have a microcomputer that is programmed to automatically execute the overall laundering process such as the water feeding, washing, rinsing, and dehydrating.

When the spin basket 2 rotates at high speeds so as to remove excess moisture from the wet laundry in the condition that the laundry is placed only at one side of the spin basket 2, its center of gravity deviates from the center of rotation, which causes the spin basket 2 to be in an out-of-balance condition. The out-of-balance spin basket 2 creates a large amount of vibration and noise to increase the chance of damage to the components of the washing machine.

A balancing device 7 containing liquid is installed on the upper part of the spin basket 2 in order to keep the dynamic balance of the spin basket 2. The balancing device 7 includes a ring-shaped case formed by joining upper and lower parts together by thermal bonding, and a saline solution 10 that is filled up to 50% in the case to counteract the imbalance.

According to the conventional washing machine, because the balancing device 7 is installed just on the upper part of the spin basket 2, it does not effectively offset unbalanced forces when a large amount of the laundry inside the spin basket 2 is being situated to one side of the center of rotation.

To explain it more specifically, referring to FIG. 6, when the spin basket 2 begins to rotate at high speeds in order to remove excess moisture from the laundry L concentrated into one spot within the spin basket 2, the saline solution 10 flows to the opposite side of the laundry. When the eccentricity of the laundry L in the spin basket 2, however, is too great for the single balancing device 7 to counteract it, the out-of-balance condition of the spin basket 2 cannot be properly corrected by the movement of the saline solution 10. In other words, because the centrifugal force F1 by the laundry L situated to one spot is larger than the centrifugal force F2 by the saline solution 10 that attempts to balance the out-of-balancing spin basket 2, the basket 2 does not tend to revolve on the geometric axis 0 but turns around an axis of rotation 0' leaning toward where the laundry L is.

Accordingly, as the axis of rotation 0' revolves around the geometric axis 0 as marked R' in FIG. 6, the spin basket 2 comes to be in an out-of-balance condition, and collides with the neighboring components to make noise and vibration.

Besides, moment M1 resulting from the weight of the laundry L is larger than opposite moment M2 resulting from the saline solution 10 in the spin basket 2 to generate rotating forces acting to left and right. Imbalanced force and moment are then applied to the spin basket 2 to make noise.

In conclusion, if the spin basket of a washing machine with the conventional balancing device begins to rotate to remove excess moisture from wet laundry while a large amount of the laundry is situated to one side therein, dynamic forces and moments on the washing machine are in unbalance conditions to make the machine vibrate, thereby creating noise and damage to the machine. Accordingly, the conventional balancing device is inadequate for washing machines with a large hydro-extracting capacity.

SUMMARY OF THE INVENTION

Accordingly, the present invention is directed to a washing machine with balancing devices that substantially obviates one or more of the problems due to limitations and disadvantages of the related art.

It is an object of the present invention to provide a washing machine having balancers mounted on the upper and lower bodies, respectively, of its spin basket for the purpose of enhancing the unbalance compensating operation and dehydration capacity of the spin basket.

It is another object of the present invention to provide balancers of a clothes washing machine which are arranged effectively to enhance both the dynamic balancing function and the available space of a spin basket.

It is to be understood that the following detailed description is intended to provide further explanation of the invention.

This invention includes a spin basket mounted in a main body and balancing means for keeping the dynamic balance of said spin basket. The balancing means includes an upper balancer mounted on the top of said spin basket and a lower balancer mounted on the bottom of said spin basket.

The upper balancer has a plurality separate ring-shaped chambers which form concentric circles and which contain balancing liquid. The lower balancer also has a plurality of ring-shaped chambers which form concentric circles, and which contain balancing liquid.

Either the upper balancer or lower balancer has its chambers arranged horizontally next to one another, and the other balancer has its chambers arranged vertically one above the other. It is preferred that in order to maximize available space of the spin basket, the chambers of the upper balancer be arranged vertically above one another, and the separated chambers of the lower balancer be arranged horizontally next to each other.

In order to enhance the dynamic balancing capability, the liquid filled in each chamber, is a viscous oil, and a number of balls are put in each of the ring-shaped chambers.

The dimension of the chambers of said upper balancer becomes larger toward the upward direction, and the size of the balls which are put in the respective chambers also becomes larger toward the upward direction in accordance with the dimension of the respective chambers.

In the same manner, the dimension of the chambers of said lower balancer becomes larger toward the outer direction, and the size of the balls which are put in the respective chambers also becomes larger toward the outer direction in accordance with the dimension of the respective chambers. It is preferred that the balls are of a metal material.

DESCRIPTION OF THE PREFERRED EMBODIMENT

A preferred embodiment of this invention will be described below, in detail, referring to the attached drawings.

Figure 1:
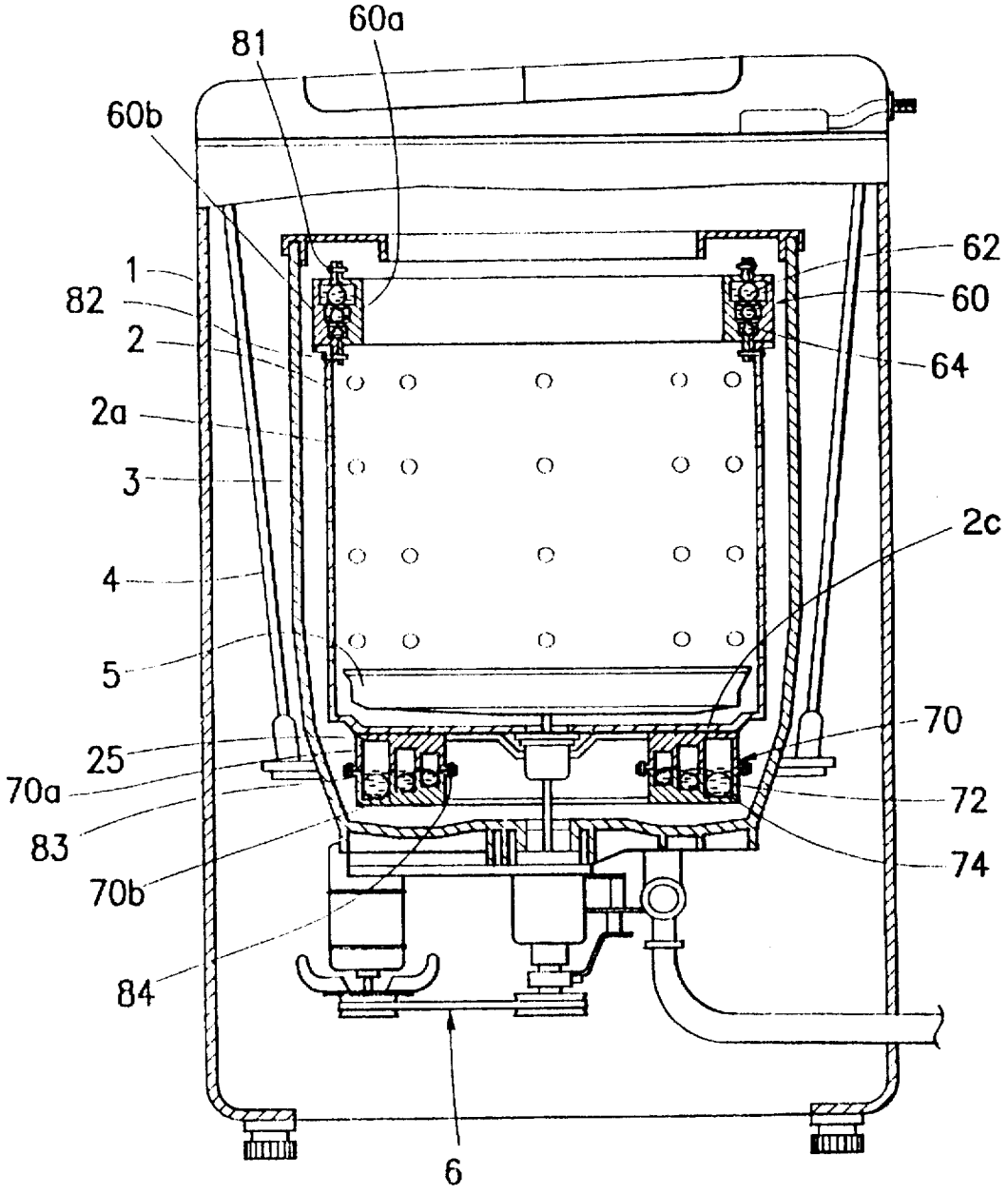
FIG. 1 is a longitudinal sectional view of a clothes washing machine on which balancers according to this invention are mounted.
Figure 5:
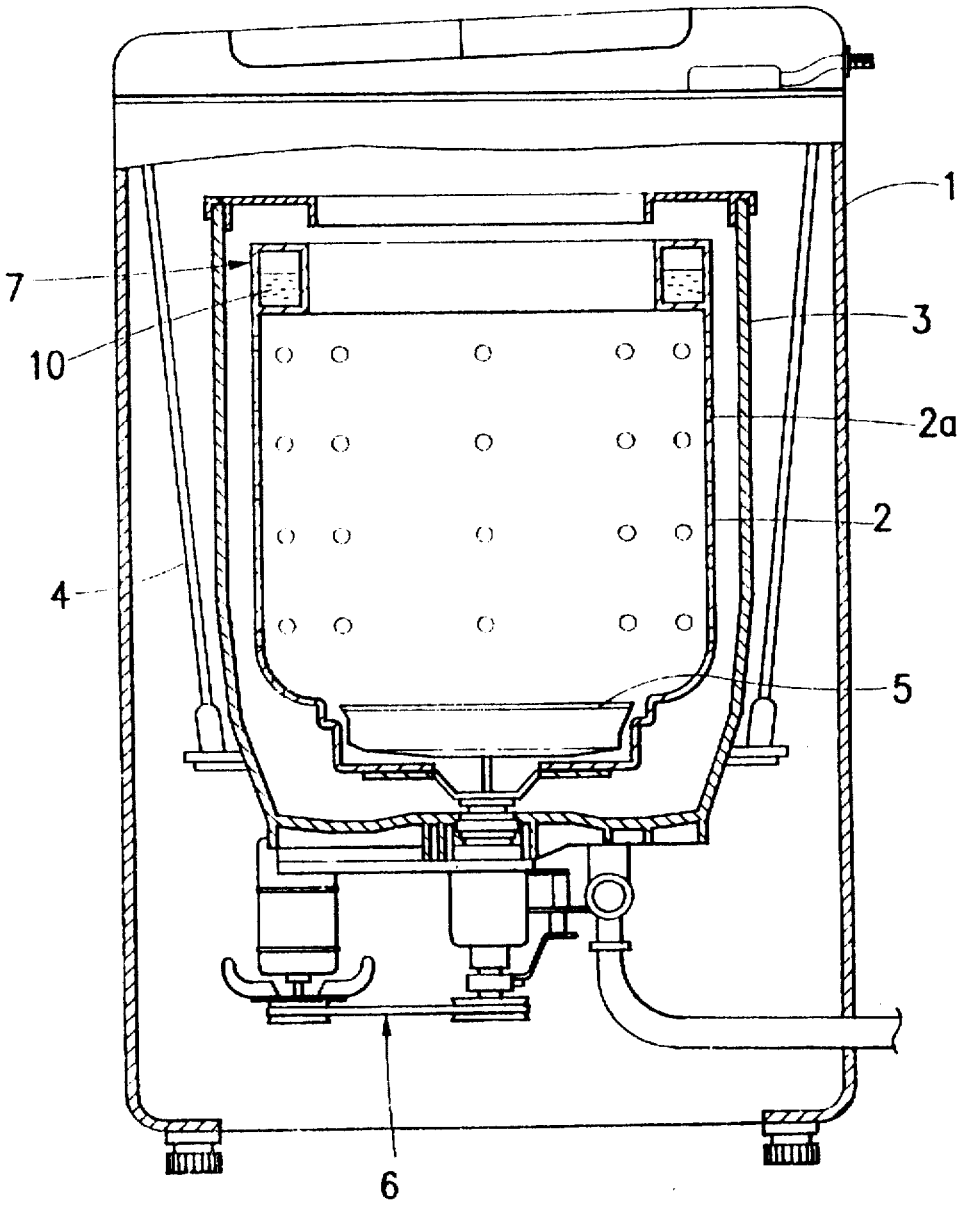
Fig. 5 (Prior Art)
FIG. 5 is a longitudinal sectional view of a clothes washing machine on which a balancer according to a prior art is mounted.
Figure 6:
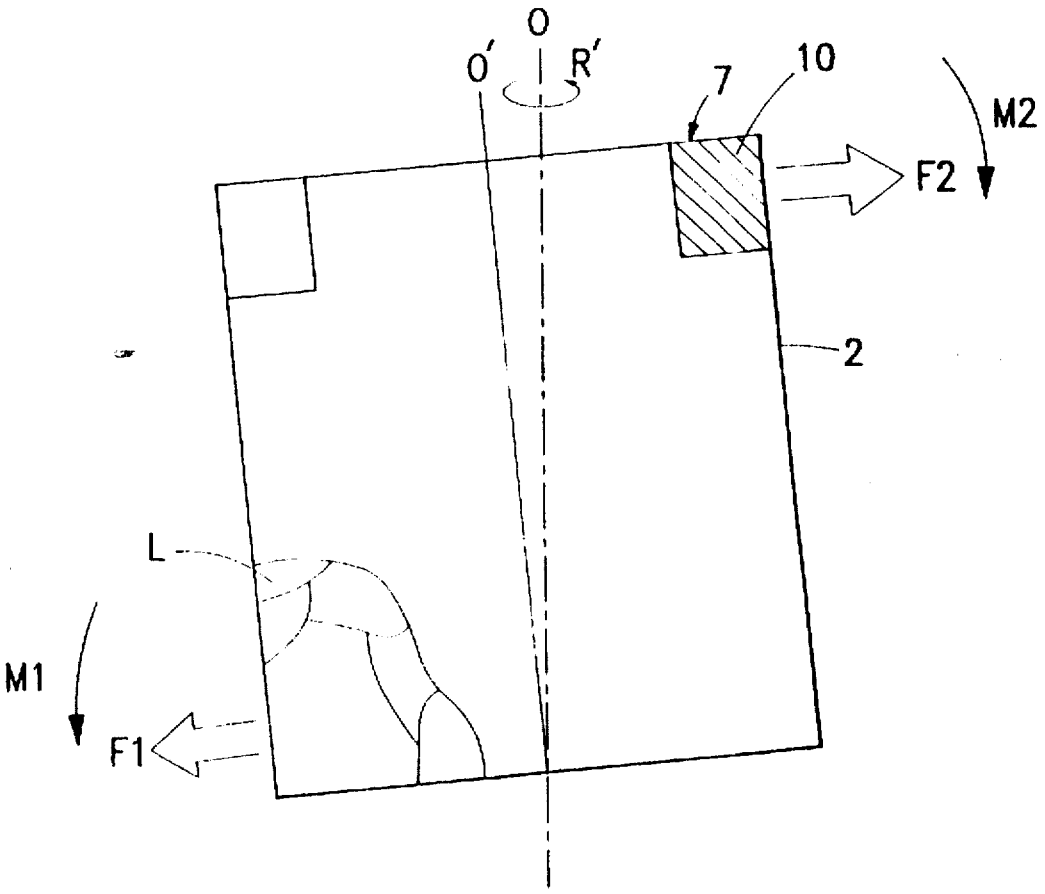
Fig. 6 (Prior Art)
FIG. 6 illustrates the relationship of forces and moments between eccentric laundry and the balancer of FIG. 5.

FIG. 1 illustrates a clothes washing machine on which balancers according to this invention are mounted. As shown in the figure, the construction of the washing machine is similar to that of FIG. 5, except for the balancing devices. Thus, redundant descriptions of features common to the conventional system and the preferred embodiment of the present invention are omitted.

In this invention, the balancing means for keeping the dynamic balance of a spin basket 2 comprises an upper balancer 60, which is mounted on the top of an upright side wall **2*b* of the spin basket 2, and a lower balancer 70, which is mounted on a bottom wall 2*c* of the spin basket 2. The upper balancer 60 has flanges 65 extending from upper and lower ends of an inner member 60*a* of the upper balancer 60 and flanges 66 extending from upper and lower ends of an outer member 60*b* of the upper balancer 60. Thus, the inner member 60*a* and outer member 60*b*, which form the upper balancer 60, are screwed to each other by screws 81,82 fitted into the flanges 65,66 at regular intervals(Refer to FIG. 2). Also, the lower screws 82, which fasten the lower parts of the inner and outer members 60*a*,60*b*, pass through the upright side wall 2*b* of the spin basket 2 to fix the upper balancer 60 to the spin basket 2, so that the upper balancer 60 is mounted on the top of the spin basket 2**.

The inner and outer members **60*a*, 60*b* adjoin one another along a cylindrical interface 100 which bisects all of the channels 63*a*, 63*b*, 63*c*. The interface is formed by first and second surfaces 60*a*', 60*b*' of the inner and outer members, respectively. The pairs of flanges 65, 66 oppose one another along the interface 100**.

The top portion of the lower balancer 70 is molded as a common body with a lower cover 25 forming a portion of the spin basket 2. In the same manner, the upper balancer 70 has a flange 75 extending from an upper member **70*a* of the lower balancer 70 and a flange 76 extending from a lower member 70*b* of the lower balancer 70, so that the upper and lower members 70*a*,70*b*, which form the lower balancer 70, are screwed to each other by screws 83,84 fitted into the flanges 75,76** at regular intervals (Refer to FIG. 3).

Figure 2:
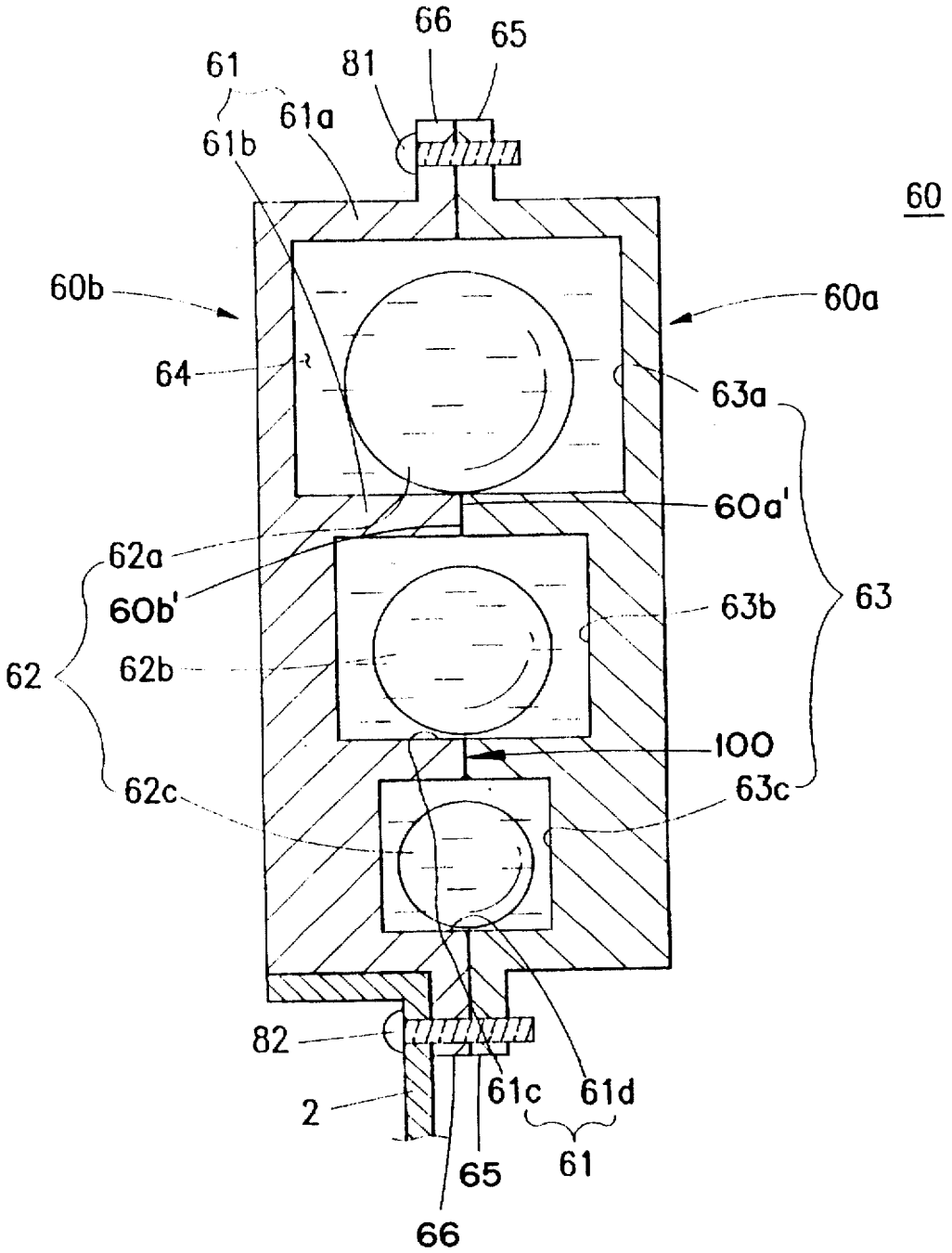
FIG. 2 is a longitudinal sectional view of the upper balancer according to this invention.

FIG. 2 is a longitudinal sectional view of the upper balancer 60. As shown in the figure, the upper balancer 60 includes a plurality of vertically separated chambers **63*a*–63*c* which are formed by a plurality of separating walls 61*a*–61*d*. In this invention, the upper balancer 60 is depicted as having three separated chambers, but the number of the separated chambers can be increased or decreased in accordance with the size of the spin basket 2**.

The respective separated chambers **63*a*–63*c* have relatively different dimensions in such a manner that the dimensions of the chambers become larger along the upward direction. Liquid 64 is filled up to about 50% volume of each chamber with a number of balls 62*a*–62*c* disposed in the separated chambers 63*a*–63*c*. Accordingly, the balls 62*a*–62*c* also have relatively different dimensions in such a manner that the sizes of balls become larger along the upward direction in accordance with the size of the respective separated chambers 63*a*–63*c***.

In the assembly of the upper balancer 60, the balls 62 are put in the separated chambers 63, and then inner member **60*a* and the outer member 60*b* are joined to each other by the screws 81,82. Next, oil 64 is put into the respective separated chambers 63*a*–63*c* through side holes(not shown) formed on each chamber 63. After that, when the side holes are sealed by plugs, the assembly of the upper balancer 60** is finished.

In short, the upper balancer 60 according to this invention is of a ring shape and has a plurality of the separated chambers 63 which are arranged vertically. The dimension of the lower chamber **63*c* is the smallest of all the chambers, and so the smallest balls 62*c* are put in the chamber 63*c* with oil 64 to be able to move along in a circumferential direction. In the middle chamber 63*b* the balls 62*b* of a middle size are arranged in the above manner, and in the upper chamber 63*a* the balls 62*a*** of the biggest size are also arranged in the above manner.

Figure 3:
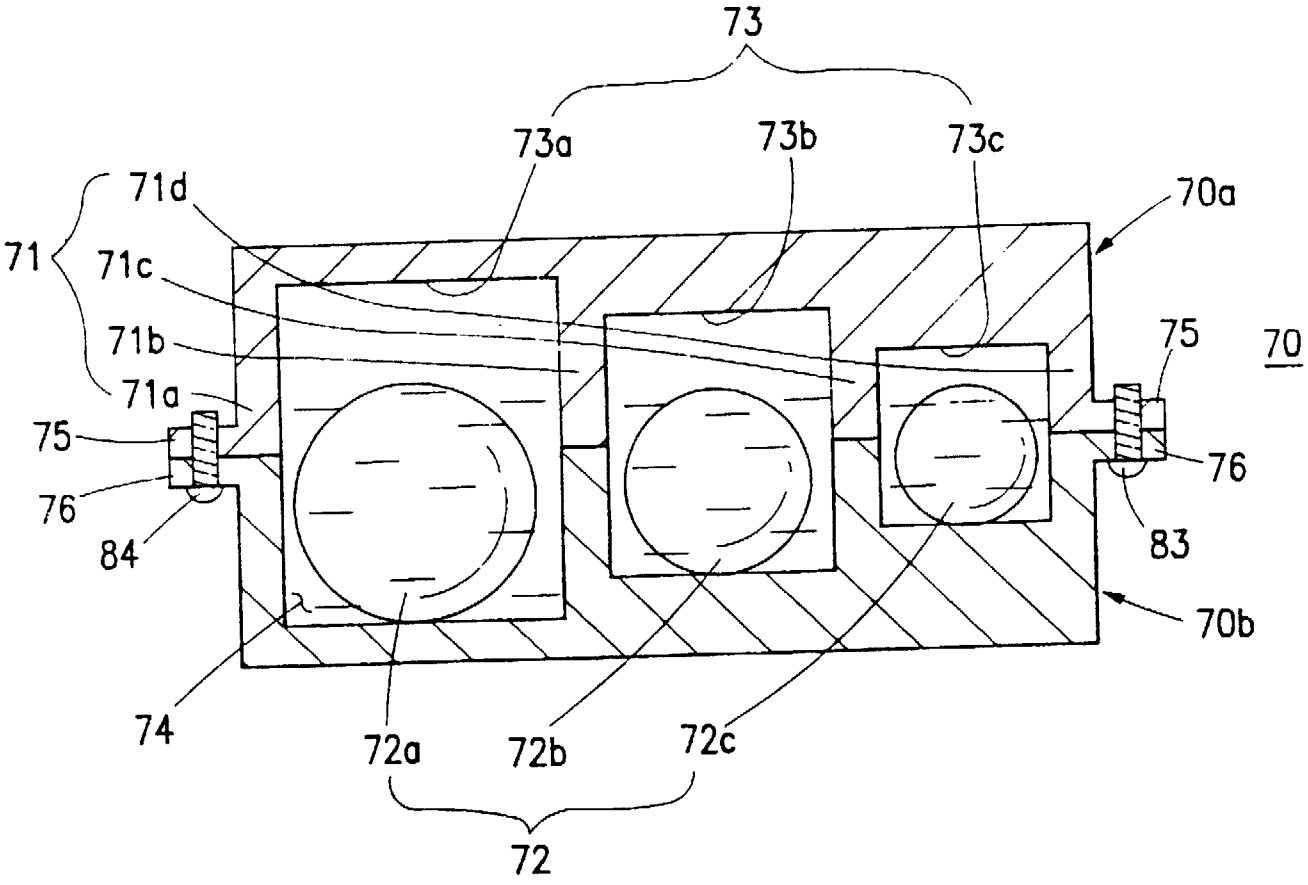
FIG. 3 is a longitudinal sectional view of the lower balancer according to this invention.

FIG. 3 is a longitudinal sectional view of the lower balancer 70. As shown in the figure, the structure of the lower balancer 70 is basically the same as that of the afore-mentioned upper balancer 60. As the only difference between the upper balancer 60 and the lower balancer 70, the respective chambers **63*a*–63*c* of the upper balancer 60 are arranged vertically one above the other, while the respective chambers 73*a*–73*c* of the lower balancer 70 are arranged horizontally next to each other. That is, the lower balancer 70 is of a ring shape and has a plurality of the chambers 73*a*–73*c*** which are arranged horizontally next to each other.

The inner chamber **73*c* of the lower balancer 70 has the smallest dimension, and therefore the balls 72*c* of the smallest size are put with oil 74 in the inner chamber 73*c* to be able to move along in a circumferential direction. In the middle chamber 73*b* the balls 72*b* of a middle size are arranged in the same manner. In the outer chamber 73*a*, the balls 72*a*** of the biggest size are also arranged in the same manner.

Figure 4:
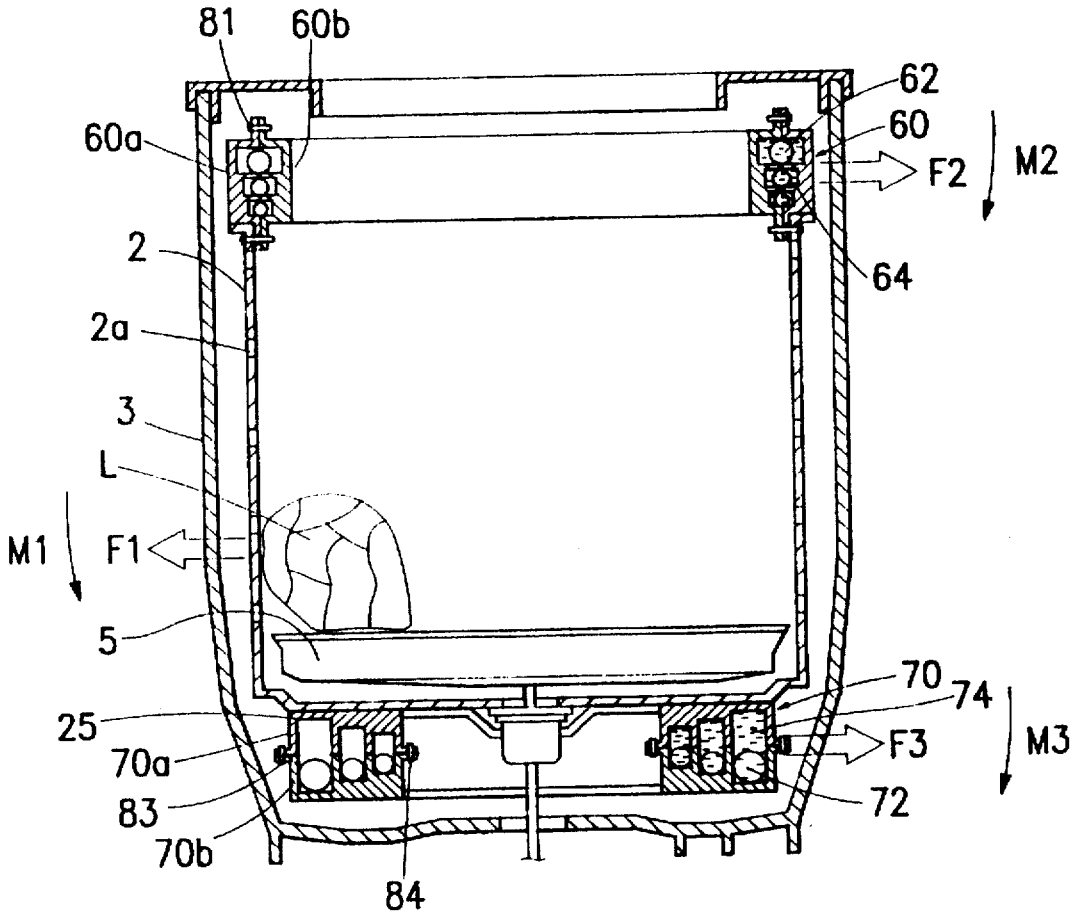
FIG. 4 illustrates the relationship of forces and moments between eccentric laundry and the balancers according to this invention.

The operation of the afore-mentioned balancers 60,70 is as follows. FIG. 4 illustrates schematically that the spin basket 2 is kept in balance by the upper and lower balancers 60,70 according to this invention when the spin basket 2 rotates at high speeds.

In the case that the rotating cylinder 2 turns at high speeds in order to extract excess water from laundry L with the condition that the laundry L in the spin basket 2 is being situated to the left side in FIG. 4 so that the spin basket 2 is in an out-of-balance condition, the balancing liquid 64,74 and the balls 62,72 contained in the upper and lower balancers 60,70 are concentrated to the right side, i.e. the opposite side of the laundry L by centrifugal force. Thus, the force and moment produced by the laundry L are offset by the opposite forces F2,F3 and moments M2,M3 due to the movement of the balancing liquid 64,74 located on the opposite side of the laundry L, so that the spin basket 2 can be in a balance condition.

As described above, because the upper balancer 60 and the lower balancer 70 of the present invention is designed to have enough space to contain a large amount of the balancing liquid 64,74, even if the amount of the laundry L is large, the balancing of forces and moments can be stably kept. On the contrary, in case that the laundry L is evenly distributed over the interior of the spin basket 2 and the center of gravity is located on the geometric axis, the balancing liquid 64,74 is evenly distributed within the upper and lower balancers 60,70, so that the spin basket 2 can rotate without vibration. Therefore, because a large mount of laundry can be dehydrated in a basket balanced by the balancers according to this invention, the dehydrating capacity of a clothes washing machine can be increased.

Further, because the balancers of this invention have a number of balls filled in viscous oil which are placed in a plurality of ring-shaped chambers formed to perform the balancing function independently, the dynamic balance of the spin basket can be stably kept.

Especially, a distinctive feature of this invention is that the chambers of the upper balancer, mounted on the top of the spin basket, are arranged vertically above each other so as not to interfere with the transfer of laundry in/out the spin basket, and the chambers of the lower balancer, mounted on the bottom of the spin basket are arranged horizontally next to each other to minimize the height of the washer. Accordingly, this invention has an advantage in that it provides sufficient balancing without reducing the washing space of the existing washing machines.

What is claimed is:

1. In a clothes washing machine including a spin basket mounted in a main body and balancing means for keeping the dynamic balance of the spin basket, the spin basket including an upstanding side wall and a bottom wall, the improvement wherein the balancing means includes an upper balancer mounted at the top of the spin basket and a lower balancer mounted at the bottom of the spin basket, the upper balancer having a plurality of separate ring-shaped chambers which are annular and coaxial, each chamber containing balancing liquid and a number of balls, the lower balancer having a plurality of separate ring-shaped chambers which are annular and coaxial, each chamber containing liquid, the lower balancer having its chambers arranged horizontally next to one another, and the upper balancer having its chambers arranged one above the other; the cross sections of the chambers of the upper balancer becoming larger in the upward direction, and the diameters of the balls disposed in those chambers becoming larger in the upward direction; the cross sections of the chambers of the lower balancer becoming larger in a radially outer direction, and the diameters of the balls disposed in those chambers becoming larger in the radially outer direction; each of the upper and lower balancers comprising first and second members adjoining one another along a cylindrical interface which bisects all of the chambers of the balancer, the interface formed by mutually abutting first and second surfaces of the first and second members, respectively, each of the first and second members including first and second flanges projecting outwardly away from the chambers, the first and second flanges of the first member opposing the first and second flanges, respectively, of the second member along the interface to form upper and lower pairs of flanges, the lower pair of flanges of the upper balancer extending into the spin basket and being mounted to the upstanding side wall thereof by fasteners passing through both the upstanding wall and the lower pair of flanges.

* * * * *